US007798733B2

(12) United States Patent
Ueda et al.

(10) Patent No.: US 7,798,733 B2
(45) Date of Patent: Sep. 21, 2010

(54) RIBBON FEEDER AND PRINTER

(75) Inventors: Masahiko Ueda, Musashino (JP); Seiji Morita, Sayama (JP); Hiroshi Sakurai, Tokorozawa (JP)

(73) Assignee: Citizen Holdings Co., Ltd., Tokyo (JP)

( * ) Notice: Subject to any disclaimer, the term of this patent is extended or adjusted under 35 U.S.C. 154(b) by 440 days.

(21) Appl. No.: 11/579,861

(22) PCT Filed: Jun. 6, 2005

(86) PCT No.: PCT/JP2005/010339

§ 371 (c)(1),
(2), (4) Date: Nov. 8, 2006

(87) PCT Pub. No.: WO2005/120844

PCT Pub. Date: Dec. 22, 2005

(65) Prior Publication Data

US 2007/0231041 A1 Oct. 4, 2007

(30) Foreign Application Priority Data

Jun. 14, 2004 (JP) ..... 2004-175776

(51) Int. Cl.
*B41J 33/00* (2006.01)

(52) U.S. Cl. ..... 400/234; 400/248

(58) Field of Classification Search ..... 400/234, 400/248

See application file for complete search history.

(56) References Cited

U.S. PATENT DOCUMENTS

| | | | | |
|---|---|---|---|---|
| 3,885,518 | A * | 5/1975 | Varni | 118/673 |
| 4,685,818 | A * | 8/1987 | Kazarian et al. | 400/249 |
| 4,768,890 | A | 9/1988 | Makino et al. | |
| 5,168,286 | A * | 12/1992 | Okauchi et al. | 347/222 |
| 5,533,819 | A * | 7/1996 | Watanabe et al. | 400/226 |
| 5,549,400 | A * | 8/1996 | Tang et al. | 400/236 |
| 6,764,234 | B2 * | 7/2004 | Ono et al. | 400/236.2 |
| 6,799,913 | B2 * | 10/2004 | Ono et al. | 400/223 |
| 7,150,572 | B2 * | 12/2006 | McNestry et al. | 400/223 |

FOREIGN PATENT DOCUMENTS

| | | |
|---|---|---|
| EP | 1236581 A1 | 9/2002 |
| JP | 61-53157 | 4/1986 |
| JP | 61-188172 | 8/1986 |

(Continued)

*Primary Examiner*—Anthony H. Hguyen
(74) *Attorney, Agent, or Firm*—Smith, Gambrell & Russell, LLP

(57) ABSTRACT

Ribbon tension detecting means (20, 21), which are formed of a plate-like lever body (35) each, are located individually on the upstream side and the downstream side of a platen (7) with respect to its travel. The plate-like lever body (35) has first and second rollers (47, 48) on the upstream and downstream sides with respect to travel of a ribbon, and swings around an axis of rotation of the second roller (48), depending on a tension of the ribbon traveling guided by the rollers (47, 48). If the amount of its swing is not less than or not more than a fixed value, a ribbon feed motor (18) or a ribbon take-up motor (19) is driven. Further, the ribbon tension detecting means (20, 21) are provided with a smoothing member which touches the ink ribbon (13) to remove wrinkles from the ink ribbon (13).

7 Claims, 8 Drawing Sheets

FOREIGN PATENT DOCUMENTS

| | | |
|---|---|---|
| JP | 62-113581 | 5/1987 |
| JP | 1-295872 | 11/1989 |
| JP | 09-169147 | 6/1997 |
| JP | 11-246093 | 9/1999 |
| JP | 2000-191194 | 7/2000 |
| JP | 2002-254782 | 9/2002 |

* cited by examiner

FIG. 12

RIBBON SUPPLY SIDE

| FIRST RIBBON TENSION DETECTOR | RIBBON FEED MOTOR |
|---|---|
| OFF | STOPPED |
| ON | ROTATING |

RIBBON TAKE-UP SIDE

| SECOND RIBBON TENSION DETECTOR | RIBBON TAKE-UP MOTOR |
|---|---|
| OFF | ROTATING |
| ON | STOPPED |

| LIGHT | FIRST AND SECOND RIBBON TENSION DETECTORS |
|---|---|
| INTERCEPTED | ON |
| TRANSMITTED | OFF |

RIBBON FEEDER AND PRINTER

TECHNICAL FIELD

The present invention relates to a ribbon feeder of a printer that uses an ink ribbon, and more particularly, to a printer that uses a transfer film ribbon and a ribbon feeder provided with ribbon tension detecting means therefor and a smoothing member in the ribbon tension detecting means.

BACKGROUND ART

In a printer that uses a transfer film ribbon (hereinafter referred to as ribbon) such as a thermal transfer film, the ribbon and a paper sheet are delivered in pressure contact between a head and a platen. If the ribbon tension varies as this is done, the feed of the ribbon is not concurrent with the feed of the paper sheet. Therefore, the ribbon may wrinkle or rub against the paper sheet, so that the print quality may be ruined in some cases.

In order to reduce the variation of the ribbon tension, in a conventional printer such as the one described in Japanese Patent Application Laid-Open No. 62-113581, a motor for a ribbon feed shaft is driven to accelerate ribbon feed if the tension of that part of the ribbon on the upstream side of the platen becomes too high. If the tension of that part of the ribbon on the downstream side of the platen becomes too low, on the other hand, a motor for a ribbon take-up shaft is driven to accelerate ribbon winding. Thus, the tension is standardized in both those parts of the ribbon on the upstream and downstream sides of the platen.

In the example described above, the ribbon tension is detected by rocking a tension arm that has a ribbon retainer portion on its distal end. This tension arm has one end rockably mounted on a printer frame and is urged in one direction by a spring. The ribbon retainer portion on the distal end has a function to remove looseness from the ribbon by engaging the ribbon.

However, the length of the tension arm must be extended in order to remove the looseness of the ribbon effectively by means of the tension arm. In consequence, an installation space must be secured lest the long tension arm interfere with other elements that constitute the printer even when it is rocked.

Further, the ribbon retainer portion that is mounted on the distal end of the tension arm has no function to remove wrinkles from the ink ribbon, although it engages the ribbon.

DISCLOSURE OF THE INVENTION

The object of the present invention is to provide a ribbon feeder configured so that a mechanism for maintaining the tension of a ribbon is compactified, operation for preventing the ribbon tension from becoming too high or too low is quick, and wrinkles that are easily generated when a wide ribbon is used can be eliminated effectively.

A ribbon feeder according to the present invention is configured so that the function of a conventional tension arm is shared by torque dampers for looseness absorption and ribbon tension detecting means. The torque dampers are located individually between a driving shaft of a ribbon feed motor and a feed shaft on which a ribbon feed roll is mounted and between a driving shaft of a ribbon take-up motor and a take-up shaft on which a ribbon take-up roll is mounted. The torque dampers are formed of coil springs such that they are rewound on the ribbon feed roll side as the ribbon feed motor rotates and are tightened on the ribbon take-up roll side as the ribbon take-up motor rotates. Stepping motors are used as the ribbon feed motor and the ribbon take-up motor.

The ribbon tension detecting means are located individually on the upstream and downstream sides of a platen and individually detect the respective tensions of those parts of the ribbon which are situated individually on the upstream and downstream sides of the platen. The ribbon tension detecting means include movable members that are displaced in accordance with the ribbon tension. The ribbon feed motor and the ribbon take-up motor are driven and stopped depending on the respective displacements of the movable members.

Further, a smoothing member is formed in the ribbon tension detecting means so that a smoothing function is added to the ribbon feeder.

According to the present invention, as described above, the smoothing function is added to the ribbon feeder, so that wrinkles in a film that are easily generated in a printer that uses a wide transfer film ribbon, in particular, can be eliminated, and high print quality can be maintained. Since the smoothing function is incorporated in the ribbon tension detecting means, the ribbon feeder can be formed compactly. Since the smoothing member is provided in the ribbon tension detecting means, moreover, the tension of the transfer film ribbon that acts on the ribbon tension detecting means can be utilized without unevenness or attenuation. Thus, the ribbon tension can be detected with high accuracy.

In the ribbon feeder according to the present invention, the torque dampers in the form of coil springs are used in place of a conventional tension arm to absorb the looseness of the ribbon. Therefore, the ribbon feeder can be compactified without using a long arm. Since the stepping motors are used as the ribbon feed motor and the ribbon take-up motor, moreover, operation for preventing the ribbon tension from becoming too high or too low can be performed quickly, so that the ribbon can be prevented from being jammed or cut. Furthermore, the torque dampers serve to absorb a shock that is caused by pulsating rotation of the stepping motors, thereby making ribbon feed smooth.

According to the ribbon feeder of the present invention, the respective tensions of those parts of the ribbon which are situated individually on the upstream and downstream sides of the platen are independently detected, and the ribbon feed motor and the ribbon take-up motor are driven and stopped depending on the result of the detection. Thus, the respective tensions of those parts of ribbons with different ribbon tension properties which are situated individually on the upstream and downstream sides of the platen can be controlled appropriately.

BRIEF DESCRIPTION OF THE DRAWINGS

FIG. 12 shows relations between ON/OFF operation of the photo-interrupter of FIG. 7 constituting the first and second ribbon tension detecting means and drive and stop of a ribbon feed motor and a ribbon take-up motor shown in FIG. 3.

BEST MODE FOR CARRYING OUT THE INVENTION

Figure 1:
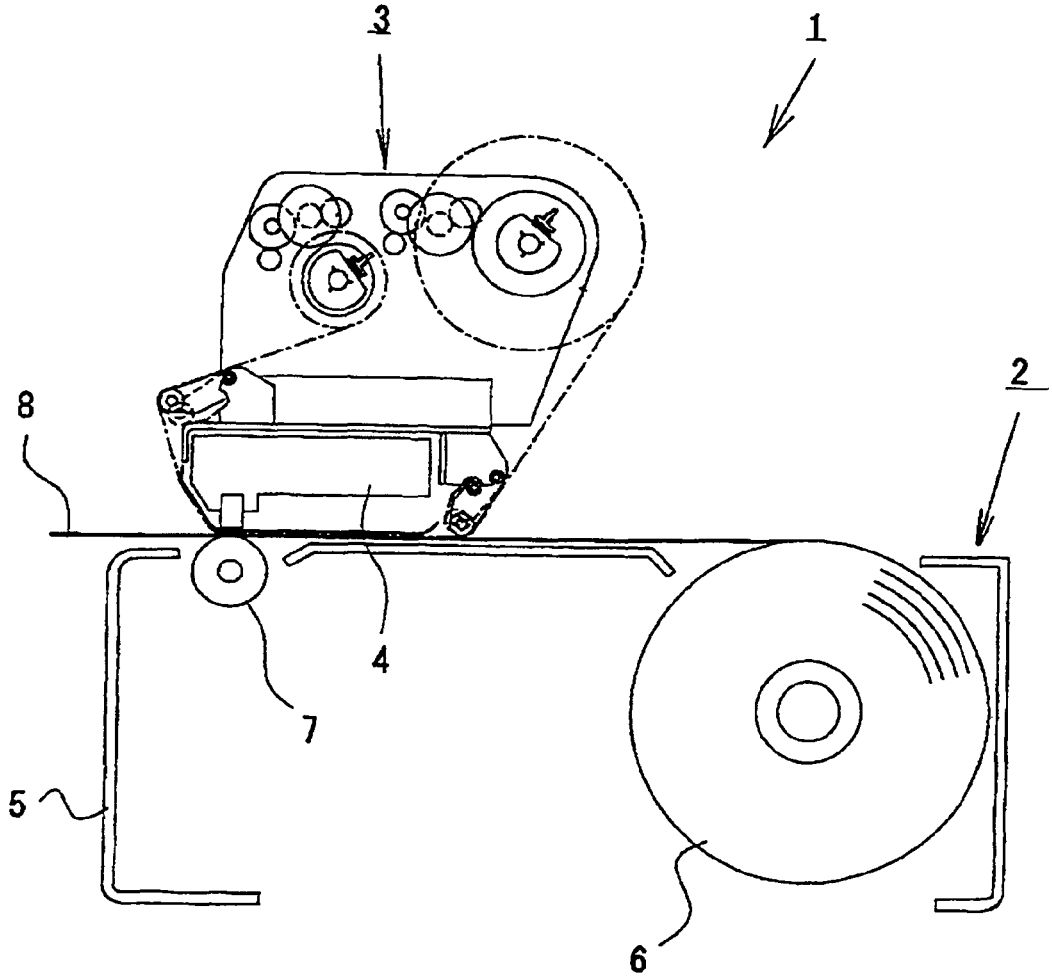
FIG. 1 is a view showing an outline of a printer using a first embodiment of a ribbon feeder according to the present invention.

A first embodiment of a ribbon feeder according to the present invention will now be described with reference to FIGS. 1 to 9.

An outline of a printer that uses a thermal transfer film ribbon will be described with reference to FIG. 1.

A printer 1 comprises a body unit 2, a ribbon feeder 3, and a head unit 4. The ribbon feeder 3 is placed on the body unit 2. The ribbon feeder 3 is configured so that it can be lifted off the body unit 2 at the time of replacement or inspection. A paper roll 6 and a platen 7 are attached to a frame 5 of the body unit 2. The platen 7 is rotated by a motor (not shown) for rotation. The top face of the frame 5 constitutes a paper transport path. A paper sheet 8 drawn out from the paper roller 6 is delivered in the leftward direction of FIG. 1 on the paper transport path as the platen 7 rotates. In this embodiment, the paper sheet 8 is a label sheet with a width of about 120 mm, which has notches 9 formed on its opposite lateral sides and arranged at given distances with respect to a feed direction, as shown in FIG. 2.

The ribbon feeder 3 will be described in detail with reference to FIG. 3.

A base 12 of the ribbon feeder 3 is composed of a horizontal baseplate 10 and vertical baseplates 11 on the opposite lateral sides of the horizontal baseplate 10. As viewed from the front, the base 12 is U-shaped. A feed shaft 14 for a thermal transfer film ribbon (hereinafter referred to as ribbon) 13, a first gear train 15 for rotating the feed shaft 14, a take-up shaft 16, and shafts that rotatably support a second gear train 17 for rotating the take-up shaft 16 are fixed on one (e.g., right-hand vertical baseplate 11) of the left- and right-hand vertical baseplates 11 that constitute the base 12. Further, the other (left-hand) vertical baseplate 11 (omitted from FIG. 3) is formed with bearing portions, which are situated individually corresponding to the feed shaft 14 and the take-up shaft 16 and rotatably support their respective driven shafts (not shown).

The first gear train 15 is a combination of gears [a], [b], . . . [g]. The gear [a] is driven by a ribbon feed motor 18 that is fixed to the rear side (side opposite the left-hand vertical baseplate 11) of the right-hand vertical baseplates 11. The ribbon feed motor 18 is a stepping motor that can be driven in forward and reverse rotation directions.

The second gear train 17 is a combination of gears [h], [i], . . . [n]. The gear [h] is driven by a ribbon take-up motor 19 that is fixed to the rear side of the right-hand vertical baseplate 11. The ribbon take-up motor 19 is also a stepping motor that can be driven in forward and reverse rotation directions.

First ribbon tension detecting means 20 is attached to the lower surface of the front end portion of the horizontal baseplate 10 that constitutes the base 12. Further, second ribbon tension detecting means 21 is attached to the upper surface of the rear end portion of the horizontal baseplate 10.

The head unit 4 is located under the horizontal baseplate 10. A ribbon guide plate 22 and a print head 23 are located under the head unit 4. In this embodiment, the print head 23 is a thermal head, which faces the platen 7.

The width of the ribbon 13 is 114 mm, which is substantially equal to the width of the paper sheet 8. The ribbon 13 is situated between the left- and right-hand vertical baseplates 11. The ribbon 13 drawn out from a ribbon supply roll 24 is fed through the first ribbon tension detecting means 20, the ribbon guide plate 22 and the second ribbon tension detecting means 21 and wound up by a take-up roll 25. Printing is performed as the print head 23 and the platen 7 vertically face the ribbon 13 that travels on the ribbon guide plate 22.

Figure 4:
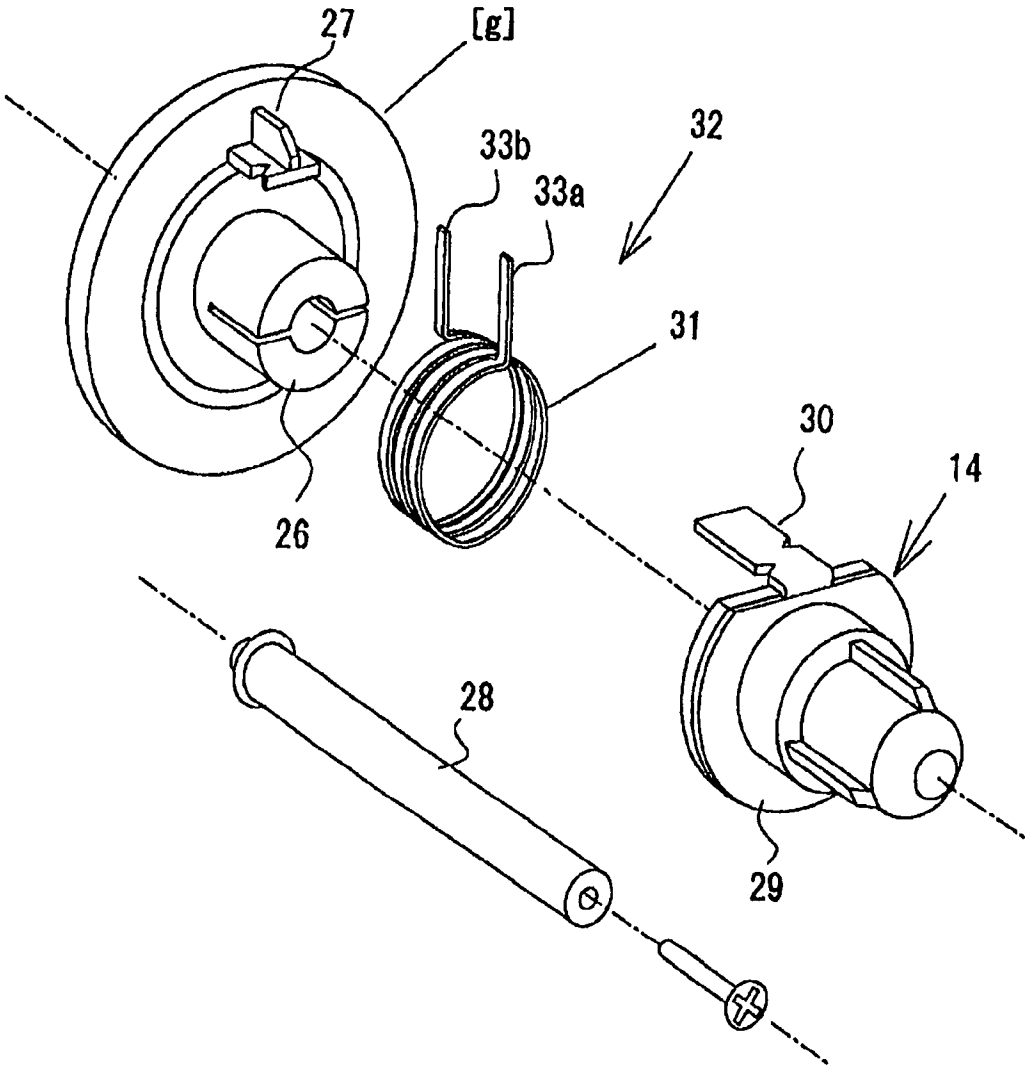
FIG. 4 is an exploded perspective view showing a feed shaft for a thermal transfer film ribbon used in the printer of FIG. 1 and its associated elements.

The feed shaft 14 of the ribbon 13 will now be described with reference to FIG. 4.

The feed shaft 14 is rotatably fitted on a supply-side driving shaft 26 that is formed integrally with the last-stage gear [g] that constitutes the first gear train 15. The supply-side driving shaft 26 is rotatably supported by a fixed shaft 28 that is fixed to the right-hand vertical baseplate 11. An engaging portion 27 protrudes from the inside face of the gear [g] in the direction of the axis of the supply-side driving shaft 26 (or toward the left-hand vertical baseplate 11).

The feed shaft 14 is provided with a collar 29, and an engaged portion 30 protrudes from the outer peripheral portion of the collar 29 in the direction of the axis of the feed shaft 14 (or toward the right-hand vertical baseplate 11).

A coil spring 31 that constitutes a torque damper 32 is fitted on the supply-side driving shaft 26 of the gear [g]. Both one end portion and the other end portion of the coil spring 31 are bent in substantially the same position on a circle, and form first and second abutting portions 33*a* and 33*b*, respectively, which extend radially outward in a straight line.

The torque damper 32 that is formed of this coil spring 31 is fitted on the supply-side driving shaft 26 of the gear [g]. Then, the feed shaft 14 is fitted onto the supply-side driving shaft 26 so that the engaged portion 30 of the feed shaft 14 is situated right under the engaging portion 27 of the gear [g] and that the engaging portion 27 and the left- and right-hand sides of the engaged portion 30 vertically overlapping one another are caused to engage the first and second abutting portions 33*a* and 33*b* of the torque damper 32.

When the ribbon 13 is pulled into the platen 7 in this state, the torque damper 32 is tightened, whereupon the tension of that part of the ribbon 13 which is situated on the upstream side of the platen 7 increases. If the ribbon feed motor 18 is driven to rotate the supply-side driving shaft 26, therefore, the torque damper is rewound, whereupon the tension of the ribbon 13 is eased.

The above-described structure for connecting the first gear train 15 of the feed shaft 14 for the ribbon 13 to the supply-side driving shaft 26 that is formed integrally with the last-stage gear [g] that constitutes the first gear train 15 is identical with the structure for connecting the take-up shaft 16 for the ribbon 13 to a take-up-side driving shaft that is formed integrally with the last-stage gear [n] that constitutes the second gear train 15, so that its illustration is omitted.

Specifically, a torque damper (constructed in the same manner as the torque damper 32) is fitted onto the take-up-side driving shaft (constructed in the same manner as the supply-side driving shaft 26). Then, the take-up shaft 16 is fitted onto the take-up-side driving shaft so that an engaged portion (constructed in the same manner as the engaged portion 30) of the take-up shaft 16 is situated right under an engaging portion (constructed in the same manner as the engaging portion 27) of the gear [n] and that the engaging portion and the left- and right-hand sides of the engaged portion vertically overlapping one another are caused to engage first and second abutting portions of the torque damper. If the ribbon take-up motor 19 is driven to rotate the take-up-side driving shaft in this state, the rotation of the take-up-side driving shaft is transmitted to the take-up shaft 16 through the torque damper (by tightening the torque damper), whereupon the ribbon 13 is wound up so that the ribbon tension increases.

The first ribbon tension detecting means and the second ribbon tension detecting means will now be described with reference to FIGS. 5 to 9.

Since the first ribbon tension detecting means 20 and the second ribbon tension detecting means 21 have the same structure, only the first ribbon tension detecting means 20 will be described in the following.

Figure 5:
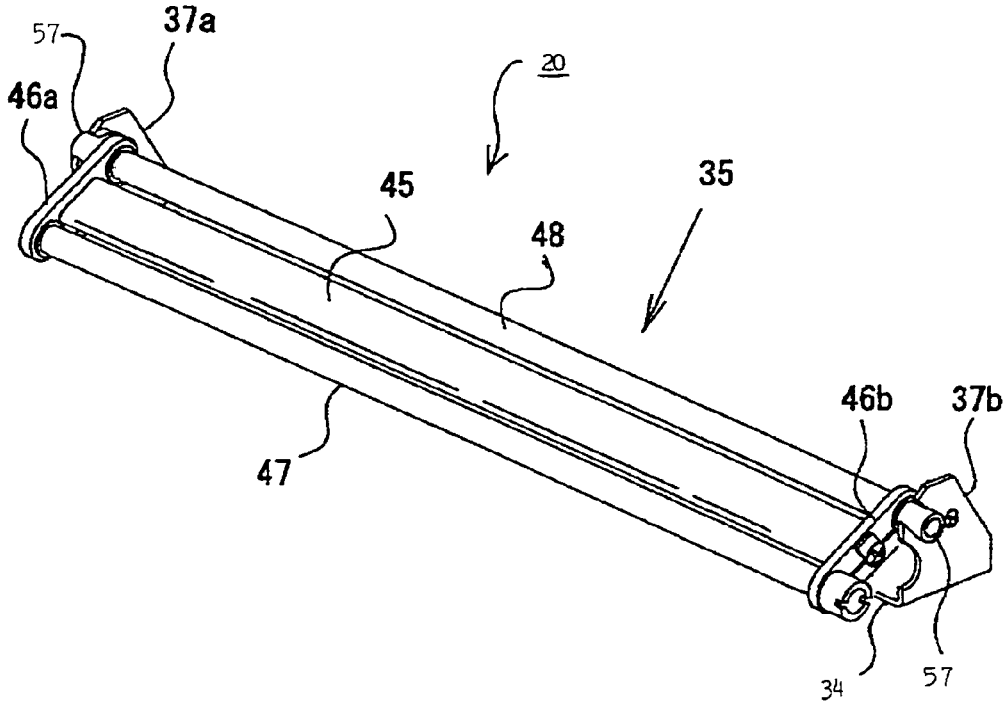
FIG. 5 is a perspective view of first ribbon tension detecting means (and second ribbon tension detecting means of the same structure) used in the ribbon feeder shown in FIG. 3.

As shown in FIG. 5, the first ribbon tension detecting means 20 comprises a base member 34 to be attached to the baseplate 10 (FIG. 3) of the ribbon feeder 3, a plate-like lever body 35, and a photo-interrupter 36 (FIG. 6) for use as an ON/OFF switch. The overall length of the first ribbon tension detecting means 20 is a little greater than the width of the paper sheet 8 or the ribbon 13, and is a length such that the detecting means 20 is just held between the left- and right-hand vertical baseplates 11 of the ribbon feeder 3.

Figure 6:
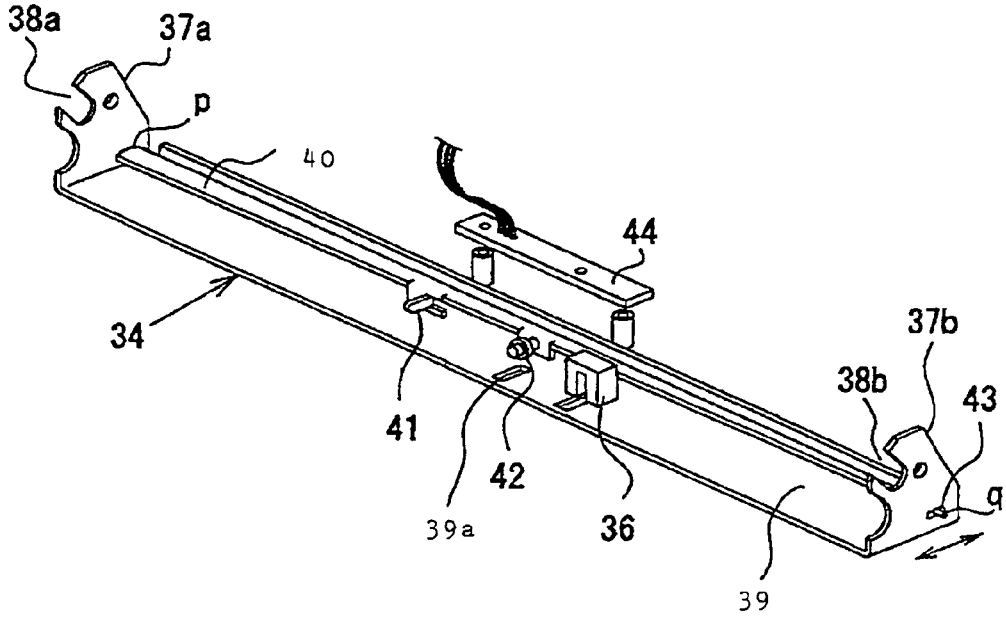
FIG. 6 is a view showing a structure of a base member with the first ribbon tension detecting means (or the second ribbon tension detecting means) shown in FIG. 5 cleared of its plate-like lever body.

As shown in FIG. 6, the base member 34 is a press-molded product that is obtained by perpendicularly bending the opposite lateral end portions of a metal sheet and is formed of a central flat plate portion 39 and left- and right-hand support plates 37*a* and 37*b*. The left- and right-hand support plates 37*a* and 37*b* are formed, respectively, with bearing recesses 38*a* and 38*b* near their upper front parts.

Further, an adjusting bar 40 is stretched parallel to the flat plate portion 39 of the base member 34 between the left-hand support plate 37*a* and right-hand support plate 37*b* over the flat plate portion 39. One end p of the adjusting bar 40 engages the left-hand support plate 37*a*, while the other end q is supported in a slit 43 of the right-hand support plate 37*b*. Thereupon, the adjusting bar 40 can be held in a predetermined posture in a manner such that it is caused to engage a retaining recess (not shown) in the slot 43 by moving the other end q back and forth (in the direction of the arrow of FIG. 6) along the slot 43. In doing this, the adjusting bar 40 is rocked around its one end p by manually operating that part of the other end q which projects outward from the slot 43 of the support plate 37*b*.

First and second engaging projections 41 and 42 protrude forward from a substantially central part of the adjusting bar 40 with respect to its longitudinal direction. A connecting circuit board 44 for transmitting an ON/OFF signal for the photo-interrupter 36 to a receiver section of the printer body is fixed to the flat plate portion 39 of the base member 34.

As shown in FIG. 5, the plate-like lever body 35 is composed of a channel-shaped member 45 having a U-shaped cross section, shaft support members 46*a* and 46*b* fixed to the opposite ends, left and right, of the channel-shaped member 45, and first and second rollers 47 and 48 that are arranged parallel to each other on the opposite sides of the channel-shaped member 45 in the front-back direction thereof.

Figure 7:
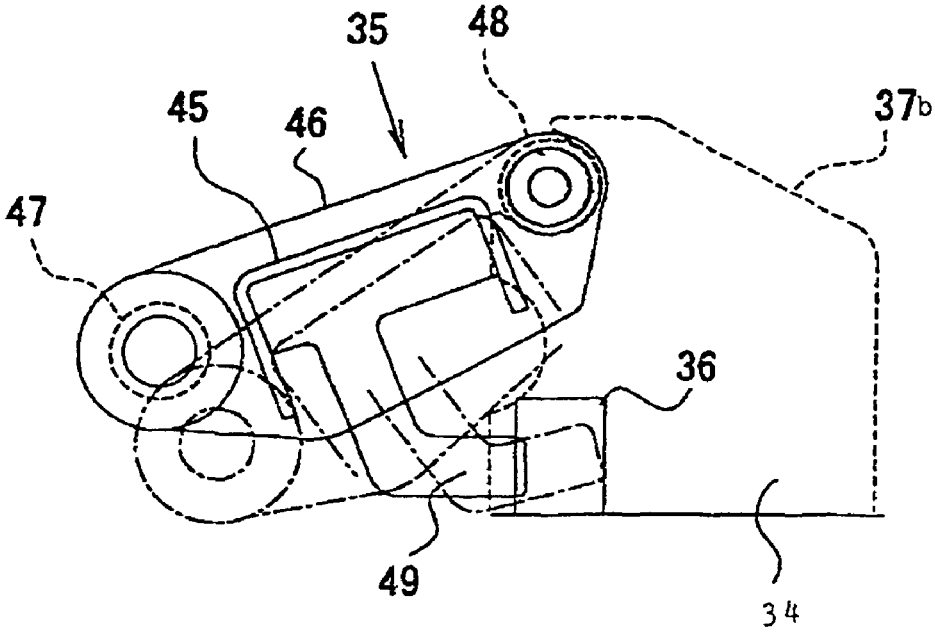
FIG. 7 is a view showing the way an ON/OFF signal is generated in a photo-interrupter when the plate-like lever body constituting the first ribbon tension detecting means shown in FIG. 5 rocks.

The first and second rollers 47 and 48 are rockably supported by the left- and right-hand shaft support members 46*a* and 46*b*. The opposite end portions, left and right, of a shaft of the second roller 48 project to the outside the shaft support members 46*a* and 46*b*, and the left- and right-hand projected shaft portions are fitted and supported individually in bearing portions 57 that engage the bearing recesses 38*a* and 38*b* in the left- and right-hand support plates 37*a* and 37*b*. In consequence, the entire plate-like lever body 35 (including the channel-shaped member 45, shaft support members 46*a* and 46*b*, and first and second rollers 47 and 48) is rockable around the axis of the second roller 48 with respect to the base member 34, as shown in FIG. 7. As the plate-like lever body 35 rocks, the first roller 47 moves in a direction to push the ribbon 13 outward. The plate-like lever body 35 is fixed to the base member 34 by fixing the bearing portions 57 with small screws (FIG. 5) screwed in threaded holes (FIG. 6) in the left- and right-hand support plates 37*a* and 37*b*.

As shown in FIG. 7, the channel-shaped member 45 is underlain by a plate-like shielding member 49, corresponding in position to the photo-interrupter 36 shown in FIG. 6. As the plate-like lever body 35 rocks around the axis of the second roller 48, the shielding member 49 gets into or out of a gap in the photo-interrupter 36, thereby causing the photo-interrupter 36 to generate the ON/OFF signal.

Figure 8:
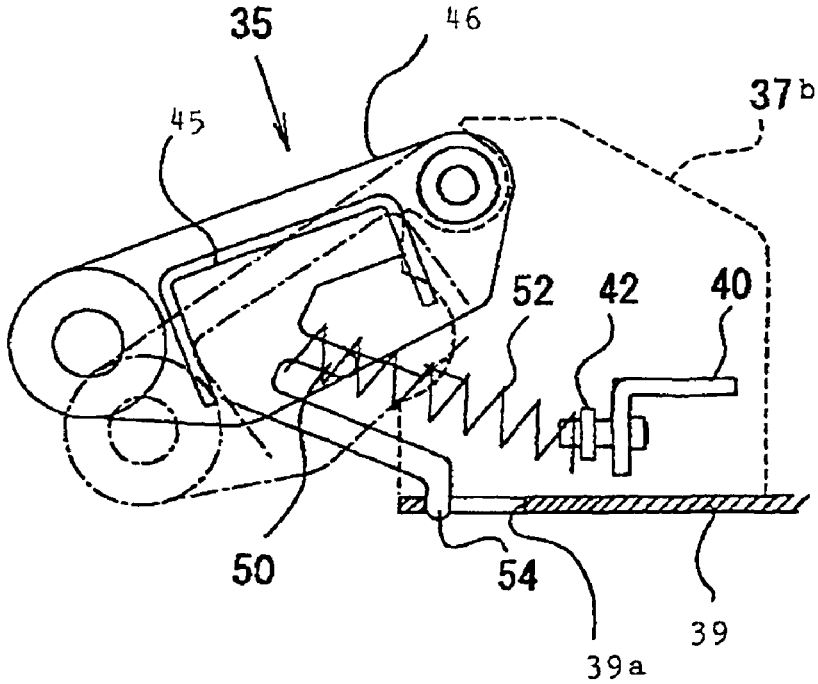
FIG. 8 is a view showing the way the plate-like lever body is continually urged to rock outward with a first spring stretched between a first engaging projection on an adjusting bar constituting the base member of FIG. 6 and a first engaged portion constituting the plate-like lever body of FIG. 5.
Figure 9:
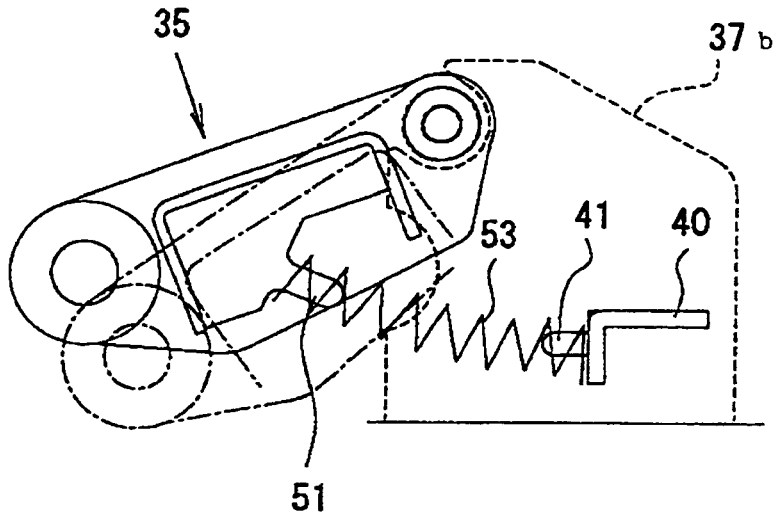
FIG. 9 is a view showing the way the plate-like lever body is continually urged to rock outward with a second spring stretched between a second engaging projection on an adjusting bar constituting the base member of FIG. 6 and a second engaged portion constituting the plate-like lever body of FIG. 5.

As shown in FIGS. 8 and 9, moreover, the channel-shaped member 45 is underlain by engaged portions 50 and 51, corresponding in position to the engaging projections 41 and 42 of the adjusting bar 40 shown in FIG. 6. Springs 52 and 53 are stretched individually between the engaged portions 50 and 51 and the engaging projections 41 and 42. These springs 52 and 53 continually urge the plate-like lever body 35 upward, that is, toward the position indicated by solid line in FIGS. 8 and 9.

As shown in FIG. 8, a stopper 54 protrudes downward from the engaged portion 50. If the engaged portion 50 is urged upward by the elasticity of the spring 52, the stopper 54 of the engaged portion 50 engages a longitudinal slot 39*a* formed in the flat plate portion 39 of the base member 34, so that the plate-like lever body 35 is prevented from rocking (or ascending) and is held in the given position (position indicated by solid line in FIG. 8).

Figure 3:
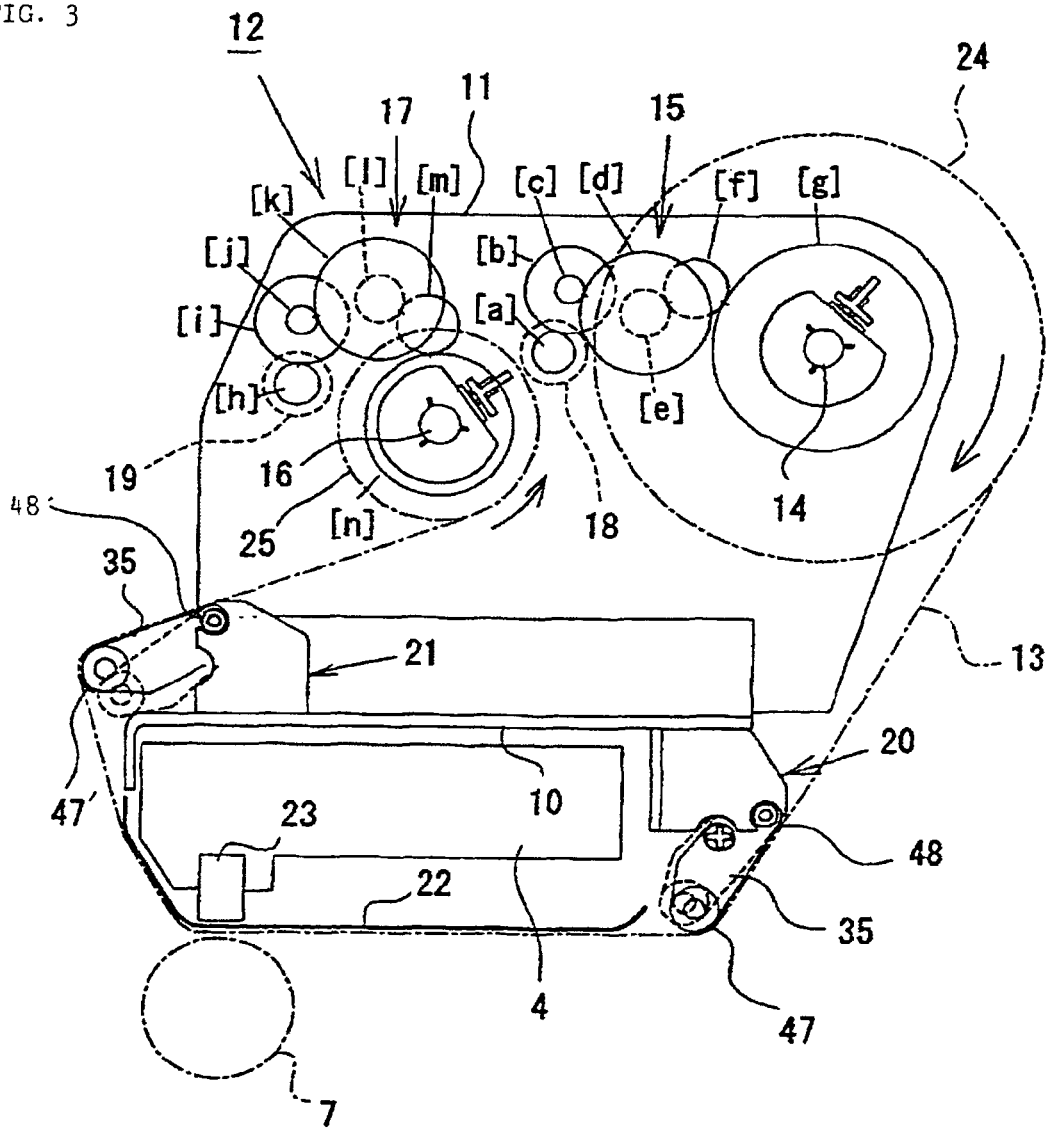
FIG. 3 is a view showing details of the ribbon feeder of FIG. 1.

As shown in FIG. 3, the first ribbon tension detecting means 20 is attached to the front side (side opposite the ribbon 13 on the upstream side of the platen 7) of the lower surface of the baseplate 10. Further, the second ribbon tension detecting means 21, which is constructed in the same manner as the first ribbon tension detecting means 20, is attached to the rear side (side opposite the ribbon 13 on the downstream side of the platen 7) of the upper surface of the baseplate 10.

When the first ribbon tension detecting means 20 is attached to the substrate 10, as shown in FIG. 3, the first roller 47 and the second roller 48 are situated on the upstream and downstream sides, respectively, of a transport path for the ribbon 13 so that the ribbon 13 is guided in conjunction with both the rollers 47 and 48. Further, the first roller 47, which is urged by the springs 52 and 53 (FIGS. 8 and 9), act in a direction to press the ribbon 13 outward.

When the second ribbon tension detecting means 21, which is constructed in the same manner as the first ribbon tension detecting means 20, is attached to the substrate 10, as shown in FIG. 3, a first roller 47' and a second roller 48' are situated on the upstream and downstream sides, respectively, of the transport path for the ribbon 13 so that the ribbon 13 is guided in conjunction with both the rollers 47' and 48'. Further, the first roller 47', which is urged by springs (constructed in the same manner as the springs 52 and 53 of FIG. 8), act in the direction to press the ribbon 13 outward.

The following is a description of the operation and action of the ribbon feeder (first embodiment) shown in FIGS. 1 to 9.

Figure 2:
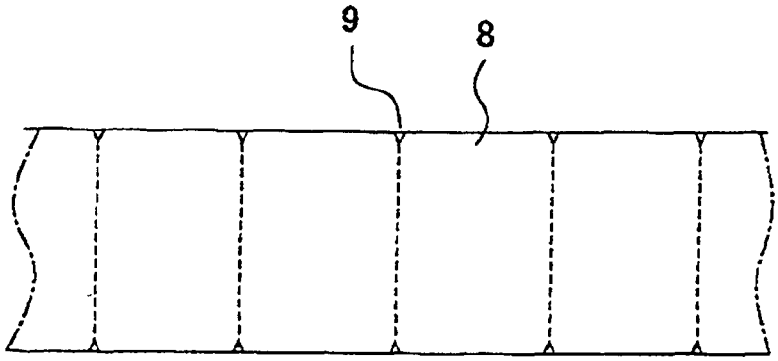
FIG. 2 is a plan view of a paper sheet used in the printer of FIG. 1.

As shown in FIG. 1, the paper roll 6 is set in the body unit 2. Then, as shown in FIG. 3, the ribbon supply roll 24 is set on the feed shaft 14 of the ribbon feeder 3, and the leading end of the ribbon 13 is drawn out from the ribbon supply roll 24 and passed around the ribbon take-up roll 25. In this state, the first and second rollers 47 and 48 of the first ribbon tension detecting means 20 and the first and second rollers 47' and 48' of the second ribbon tension detecting means 20 are all in contact with the ribbon 13.

When a print signal is inputted to the printer 1, both the paper sheet 8 and the ribbon 13 are drawn in toward the platen 7. The ribbon 13 delivered from the ribbon supply roll 24 touches the first and second rollers 47 and 48 of the first ribbon tension detecting means 20, whereupon its course is changed. Then, the ribbon 13 rotates the rollers 47 and 48 as it travels toward the platen 7.

When the ribbon 13 is drawn in toward the platen 7, relative rotation is caused between the feed shaft 14 that is loaded with the ribbon supply roll 24 and the supply-side driving shaft 26 (FIG. 4) on which the feed shaft 14 is fitted. In consequence, the engaged portion 30 of the feed shaft 14 clamps the coil spring 31 that constitutes the torque damper 32 as it moves relatively to the engaging portion 27 of the supply-side driving shaft 26. Thus, the tension of the ribbon 13 increases.

If the tension of the ribbon 13 becomes excessively high, the first roller 47 (FIG. 5) that constitutes the first ribbon tension detecting means 20 is pushed by the ribbon 13 and excessively rocks around the axis of the second roller 48 with respect to the base member 34. In consequence, the shielding member 49 that moves integrally with the first roller 47 gets into the gap in the photo-interrupter 36, as indicated by dash-dotted line in FIG. 7, thereby blocking light transmission through the photo-interrupter 36. Thus, the photo-interrupter 36 is caused to generate the ON/OFF signal, whereupon the ribbon feed motor 18 starts to be driven. When the ribbon feed motor 18 is driven, the driving shaft 26 rotates relatively to the feed shaft 14, whereupon the engaging portion 27 of the supply-side driving shaft 26 moves relatively to the engaged portion 30 of the feed shaft 14 in a direction to loosen the coil spring 31 that constitutes the torque damper 32. In consequence, the tension of the ribbon 13 is eased.

When the ribbon 13 is delivered from the platen 7, on the other hand, that part of the ribbon 13 which is situated on the downstream side of the platen 7 loosens. Accordingly, the first roller 47' that constitutes the second ribbon tension detecting means 21 rocks around the axis of the second roller 48' in a direction to retreat to the inside of the ribbon 13 with respect to the base member 34. In consequence, as in the case indicated by solid line in FIG. 7, the shielding member 49 that moves integrally with the first roller 47' slips out of the gap in the photo-interrupter 36, thereby allowing light transmission through the photo-interrupter 36. Thus, the photo-interrupter 36 is caused to generate an OFF signal, whereupon the ribbon take-up motor 19 is driven. When the ribbon take-up motor 19 is driven, the supply-side driving shaft 26 rotates relatively to the feed shaft 14, whereupon the engaging portion 27 of the supply-side driving shaft 26 moves relatively to the engaged portion 30 of the feed shaft 14 in a direction to tighten the coil spring 31 that constitutes the torque damper 32. In consequence, the tension of that part of the ribbon 13 which is situated on the downstream side of the platen 7 is increased.

In this manner, the plate-like lever body 35 that forms the first or second ribbon tension detecting means 20 or 21 rocks around the axis of the second roller 48 or 48' with respect to the base member 34, depending on the tension of the ribbon. These second rollers 48 and 48' function as idle rollers that are situated in fixed positions and are rotated as the ribbon travels.

The torque damper 32 uses its elastic force continually to keep the respective tensions of those parts of the ribbon 13 which are situated individually on the upstream and downstream sides of the platen 7 at predetermined levels. Further, the torque damper 32 has a function to ease a shock that is generated when the ribbon feed motor 18 or the ribbon take-up motor 19, a stepping motor, rotates.

Then, FIG. 12 shows relations between the ON/OFF operation of the photo-interrupter 36 and drive and stop of the individual drive motors.

In the ribbon feeder according to the first embodiment, a tension adjustment mechanism for the ribbon 13 is actuated depending only on the change of the ribbon tension, so that it is not influenced by the change of the diameter of the ribbon supply roll 24 or the take-up roll 25.

Since the ribbon tension can be kept substantially at preset values at the upstream side and the downstream side of the platen 7, individually, a shift of the printing position or rubbing that may be caused when the ribbon 13 is fed faster or slower than by the platen cannot easily occur. Thus, there is no awkward possibility of the label sheet being printed beyond the position (FIG. 2) of a notch 9 or the print surface being streaked.

If the tension of the ribbon 13 requires fine adjustment, the position of the adjusting bar 40 of the plate-like lever body 35 is shifted back and forth along the slot 43 (FIG. 6) to adjust the length of the springs 52 and 53.

The photo-interrupter 36 can be constructed at low cost, since it is only used as an ON/OFF switch that can only drive and stop the ribbon feed motor 18 and ribbon take-up motor 19.

A second embodiment of the ribbon feeder according to the present invention will now be described with reference to FIG. 10.

In the foregoing ribbon feeder according to the first embodiment, the ribbon supply roll 24 (externally wound roll) used is formed by winding the ribbon 13 with its transfer ink layer outward.

Figure 10:
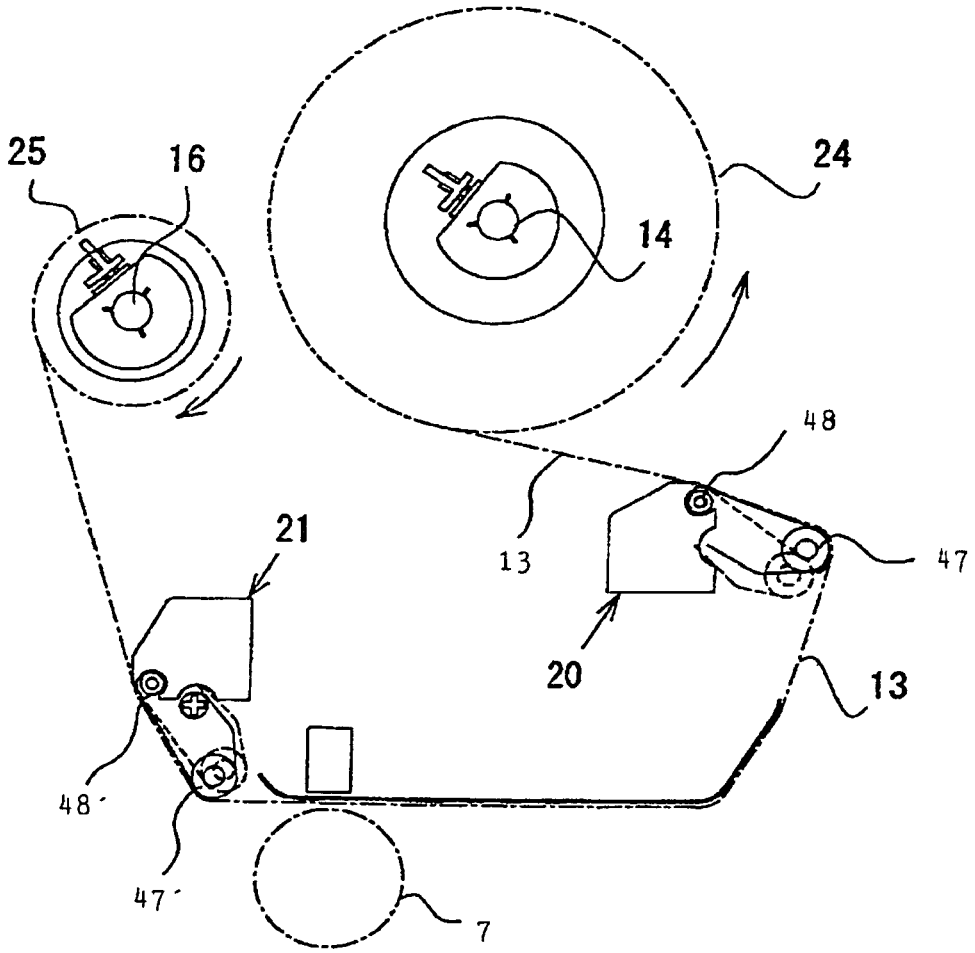
FIG. 10 is a schematic view showing a second embodiment of the ribbon feeder according to the present invention.

FIG. 10 shows the ribbon feeder according to the second embodiment that uses a ribbon supply roll 24 (internally wound roll) that is formed by winding a ribbon 13 with its transfer ink layer inward. In this embodiment, the feed shaft 14 and the take-up shaft 16 are rotated in opposite directions, when compared with the case of the first embodiment. Thus, the difference lies only in the reverse winding direction of a coil spring 31 that constitutes a torque damper 32, and other configurations are the same.

Abutting portions 33*a* and 33*b* at the opposite ends of the torque damper 32 are in engagement with the opposite sides of the engaging portion 27 and the engaged portion 30. Even if the ribbon feed of the externally wound roll must be reversed for any reason, therefore, other configurations can be directly used as they are by only reversing the rotation direction.

A third embodiment of the ribbon feeder according to the present invention will now be described with reference to FIG. 11.

Figure 11:
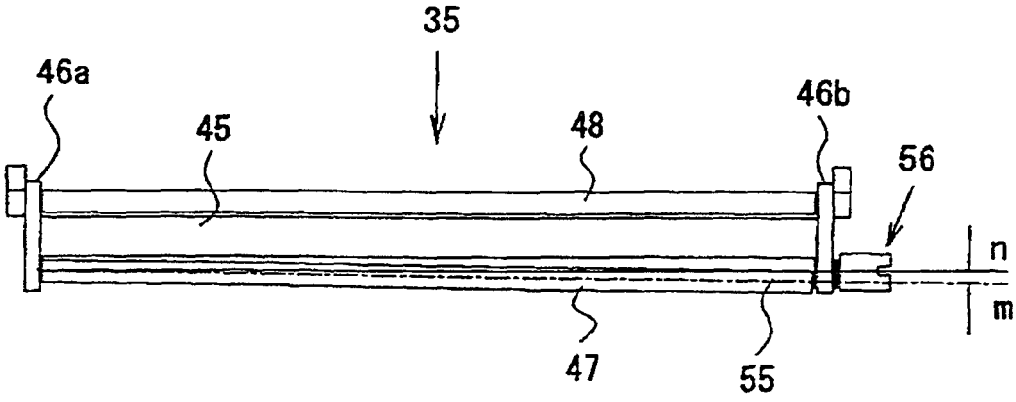
FIG. 11 is a view illustrating a plate-like lever body constituting a third embodiment of the ribbon feeder according to the present invention.

FIG. 11 shows a plate-like lever body 35 that is taken out from the ribbon feeder according to the third embodiment. In this drawing, an operating shaft 55 penetrates a first roller 47 that constitutes the plate-like lever body 35. The left-hand end of the operating shaft 55 is supported by a left-hand shaft support member 46*a* for rotation around its axis. On the other hand, the right-hand end of the operating shaft 55 is eccentrically connected to a control knob 56 that penetrates a right-hand shaft support member 46*b* from outside to inside. Thus, an axis n of the operating shaft 55 of the first roller 47 is not in alignment with an axis m of a shaft of the control knob 56, as shown in FIG. 11.

If the control knob 56 is manually rotated, therefore, the operating shaft 55 rocks around a central axis between the left- and right-hand shaft support members 46*a* and 46*b*, depending on the amount of rotation of the control knob 56, and its right-hand end side vertically moves around its left-hand end, whereupon the inclination of the operating shaft 55 to the central axis of a second roller 48 changes. Thus, by rotating the control knob 56 for an appropriate amount, the first roller 47 can be held inclined at an angle corresponding to the amount of rotation of the control knob 56 to the second roller 48.

In the ribbon feeder of the present embodiment that uses first and second ribbon tension detecting means 20 and 21 with the lever body 35 shown in FIG. 11, if the ribbon 13 used is wide, the feed rate of the ribbon 13 with respect to its width direction fails to be uniform, owing to maldistribution of the tension of a film that forms the base of the ribbon 13 or maldistribution of thermal influences, and the ribbon 13 may continuously wrinkle, in some cases. In the case where the ribbon feeder of this type is used in a thermal transfer printer, in particular, the amount of heat received by the film with respect to the width direction of the ribbon 13 varies if the amount of printing is subject to variation in the width direction of the paper sheet 8, with the result that the ribbon 13 is liable to wrinkle. In such a case, the ribbon can be prevented from wrinkling if the control knob 56 is manually operated so that the angle of inclination of the first roller 47 is changed to adjust the ribbon feed rate in the width direction. Thus, according to the present embodiment, the print quality can be maintained by handy, simple means.

The following is a description of a fourth embodiment of the ribbon feeder according to the present invention.

In this embodiment, a timer for measuring ON/OFF switching intervals of the photo-interrupters 36 (FIGS. 6 and 7) that constitute the first and second ribbon tension detecting means 20 and 21 is attached to the ribbon feeder. The timer may be configured so that if it is detected that the ON/OFF state of the output of the photo-interrupter 36 is not switched after the passage of a time period not shorter than an ON/OFF switching interval that is normally predicted by the timer, it is concluded that the ink ribbon feed is abnormal, and an alarm (not shown) is issued.

If the photo-interrupter 36 that constitutes the first ribbon tension detecting means 20 is kept OFF for a long period of time, that is, if the shielding member 49 that moves integrally with the first roller 47 is kept outside the gap in the photo-interrupter 36 for a long period of time, for example, it is supposed that the ribbon 13 is cut on the upstream side of the platen 7.

Further, it is supposed that the trailing end of the roll is reached by the ribbon 13 if the photo-interrupter 36 that constitutes the first ribbon tension detecting means 20 is kept ON (that is, if the shielding member 49 that moves integrally with the first roller 47 is kept inside the gap in the photo-interrupter 36) for a long period of time, and if the photo-interrupter 36 that constitutes the second ribbon tension detecting means 21 is kept ON (that is, if the shielding member 49 that moves integrally with the first roller 47' is kept inside the gap in the photo-interrupter 36) for a long period of time.

Although the torque damper 32 is formed of a coil spring in each of the embodiments described above, it may be formed of a spring of any other form.

The invention claimed is:

1. A ribbon feeder comprising:

a print head for printing ink of an ink ribbon on a paper sheet, a ribbon tension detecting means for detecting a tension of the ink ribbon, a ribbon take-up shaft for winding up the ink ribbon, and a ribbon take-up motor for rotating the ribbon take-up shaft; wherein said ribbon tension detecting means directly engages the ink ribbon between the ribbon take-up shaft and the print head and detects the tension of the ink ribbon wound up by the ribbon take-up shaft; and said ribbon tension detecting means having a smoothing member and a control section for adjusting said smoothing member, said control section being provided at an end of said smoothing member in a manner such that a central axis of said control section and a central axis of said smoothing member are eccentric to each other, allowing an inclination angle of said smoothing member with respect to the traveling direction of the ink ribbon to be adjusted by operating said control section, thereby allowing said smoothing member to prevent wrinkles from occurring in the ink ribbon.

2. The ribbon feeder according to claim 1, wherein the ribbon tension detecting means has a roller which is located nearer to the ribbon take-up shaft than the smoothing member so as to engage the ink ribbon, and the ribbon tension detecting means rocks around the roller, depending on the tension of the ink ribbon wound up by the ribbon take-up motor.

3. A ribbon tension detecting means for a printer which uses a transfer film ribbon, the ribbon tension detecting means comprising:

a base member fixed to a frame of the printer;

a plate-like lever body which is movable with respect to the base member and engages the transfer film ribbon;

a detector;

a feed shaft for feeding the transfer film ribbon through the printer;

a ribbon feed motor for driving the feed shaft;

a take-up shaft for receiving the transfer film ribbon; and a ribbon take-up motor for driving the take-up shaft, wherein said plate-like lever body includes a first roller and a second roller which each guide the transfer film ribbon, wherein the transfer film ribbon travels in a direction from the first roller to the second roller, and the first and second rollers have respective axes of rotation thereof arranged parallel to each other and at right angles to a traveling direction of the transfer film ribbon, and said plate-like lever body is configured to rock around the axis of rotation of the second roller, depending on a tension of the transfer film ribbon traveling guided by the first and second rollers, and said detector being arranged as to start driving the ribbon feed motor or the ribbon take-up motor when the amount of rocking thereof is not less than or not more than a fixed value, based on the tension of the transfer film ribbon.

4. The ribbon tension detecting means of claim 3 wherein said detector comprises a photo-interrupter.

5. A ribbon tension detecting means for a printer which uses a transfer film ribbon, the ribbon tension detecting means comprising:

a base member fixed to a frame of the printer;

a plate-like lever body which is movable with respect to the base member and engages the transfer film ribbon;

a detector;

a feed shaft for feeding the transfer film ribbon through the printer;

a ribbon feed motor for driving the feed shaft;

a take-up shaft for receiving the transfer film ribbon; and a ribbon take-up motor for driving the take-up shaft, wherein said plate-like lever body includes a first roller and a second roller, wherein the transfer film ribbon travels in a direction from the first roller to the second roller, and the first and second rollers have respective axes of rotation thereof arranged parallel to each other and at right angles to a traveling direction of the transfer film ribbon, wherein said plate-like lever body is configured to rock around the axis of rotation of the second roller, depending on a tension of the transfer film ribbon traveling guided by the first and second rollers, and said detector being arranged as to start driving the ribbon feed motor or the ribbon take-up motor when the amount of rocking thereof is not less than or not more than a fixed value, wherein said plate-like lever body further comprises a first roller rotation shaft having a first end and a second end, and wherein the first end and the second end of said first roller rotation shaft are individually supported on the base member so that the first end is rockable around the second end, such that a space between a first end of the first roller and a first end of the second roller is made changeable within a predetermined range while a space between a second end of the first roller and a second end of the second roller is kept constant.

6. A ribbon tension detecting means according to claim 5, wherein said plate-like lever body further comprises an operation shaft, and wherein the first end of the first roller rotation shaft is connected to the operation shaft which penetrates the base member in a manner such that a central axis of the first roller rotation shaft and a central axis of the operation shaft are eccentric to each other, and wherein the operating shaft is rotatable so that the space between the first end of the first roller and the first end of the second roller is adjusted while a space between the second end of the first roller and the second end of the second roller is kept constant.

7. The ribbon tension detecting means of claim 6 wherein said operation shaft comprises a control knob extending out away from said base member, which control knob, upon rotation, changes spacing between the first ends of said first and second rollers.

* * * * *